US006295902B1

(12) United States Patent
Lin

(10) Patent No.: US 6,295,902 B1
(45) Date of Patent: Oct. 2, 2001

(54) HANDLE OF HAND TOOL

(76) Inventor: Chung-Chiang Lin, No. 1, Lane 28, Tai Chou Street, He Nan Li, Hsi Chun Area, Taichung (TW)

( * ) Notice: Subject to any disclaimer, the term of this patent is extended or adjusted under 35 U.S.C. 154(b) by 0 days.

(21) Appl. No.: 09/494,505

(22) Filed: Jan. 31, 2000

(51) Int. Cl.[7] ..... B25G 1/01
(52) U.S. Cl. ..... 81/489; 81/20; 81/177.1
(58) Field of Search ..... 81/20, 22, 177.1, 81/489

(56) References Cited

U.S. PATENT DOCUMENTS 4,548,248 * 10/1985 Riemann ..... 81/22
4,882,955 * 11/1989 Savnik ..... 81/20
5,926,911 * 7/1999 Chen ..... 81/22 X

* cited by examiner

*Primary Examiner*—James G. Smith
(74) *Attorney, Agent, or Firm*—Browdy and Neimark

(57) ABSTRACT

A hand tool comprises a head and a handle fastened at one end thereof with the head. The handle comprises a body, and a protective sleeve fitted over the body such that the protective sleeve and the body are held securely together by two fastening members, which are located in two opposite side walls of the protective sleeve and are connected by at least one connection member.

9 Claims, 4 Drawing Sheets

HANDLE OF HAND TOOL

FIELD OF THE INVENTION

The present invention relates generally to a hand tool, and more particularly to a handle of the hand tool.

BACKGROUND OF THE INVENTION

The conventional hand tools, such as a hammer, a wrench, a hatchet, etc., are formed of a head and a handle fastened at one end thereof with the head. The head may be of various shapes, depending on the nature of the hand tool. The handle of the conventional hand tool may be made of a wooden rod, a metal bar, or a metal bar which is provided. with a protective jacket of a plastic or rubber material. The protective jacket is generally formed by injection molding. The protective jacket may be made separately and then fitted over the handle in conjunction with an adhesive. The protective jacket of the conventional hand tool is prone to become detached from the handle.

SUMMARY OF THE INVENTION

The primary objective of the present invention is to provide the handle of a hand tool with a protective sleeve which is securely fitted over the handle.

The objective of the present invention is attained by a hand tool comprising a head and a handle which has a body and a protective sleeve fitted over the body of the handle in conjunction with a first fastening member, a second fastening member, and at least one connection member. The protective sleeve is held securely in place by the first fastening member and the second fastening member, which are in turn held securely by the connection member.

The objective, features, and functions of the present invention will be more readily understood upon a thoughtful deliberation of the following detailed description of the embodiments of the present invention with reference to the accompanying drawings.

DETAILED DESCRIPTION OF THE INVENTION

Figure 1:
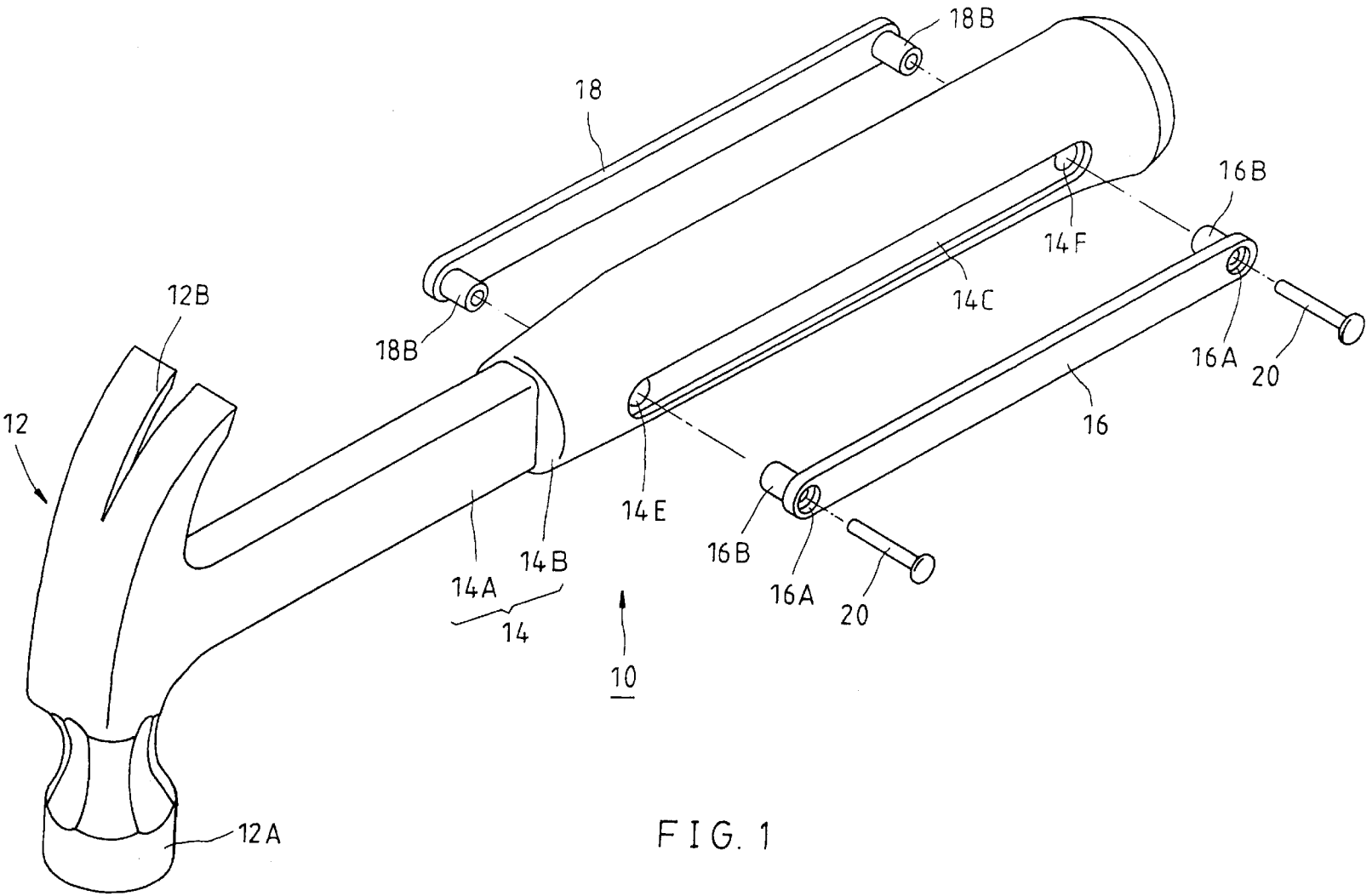
FIG. 1 shows an exploded view of a first preferred embodiment of the present invention.
Figure 2:
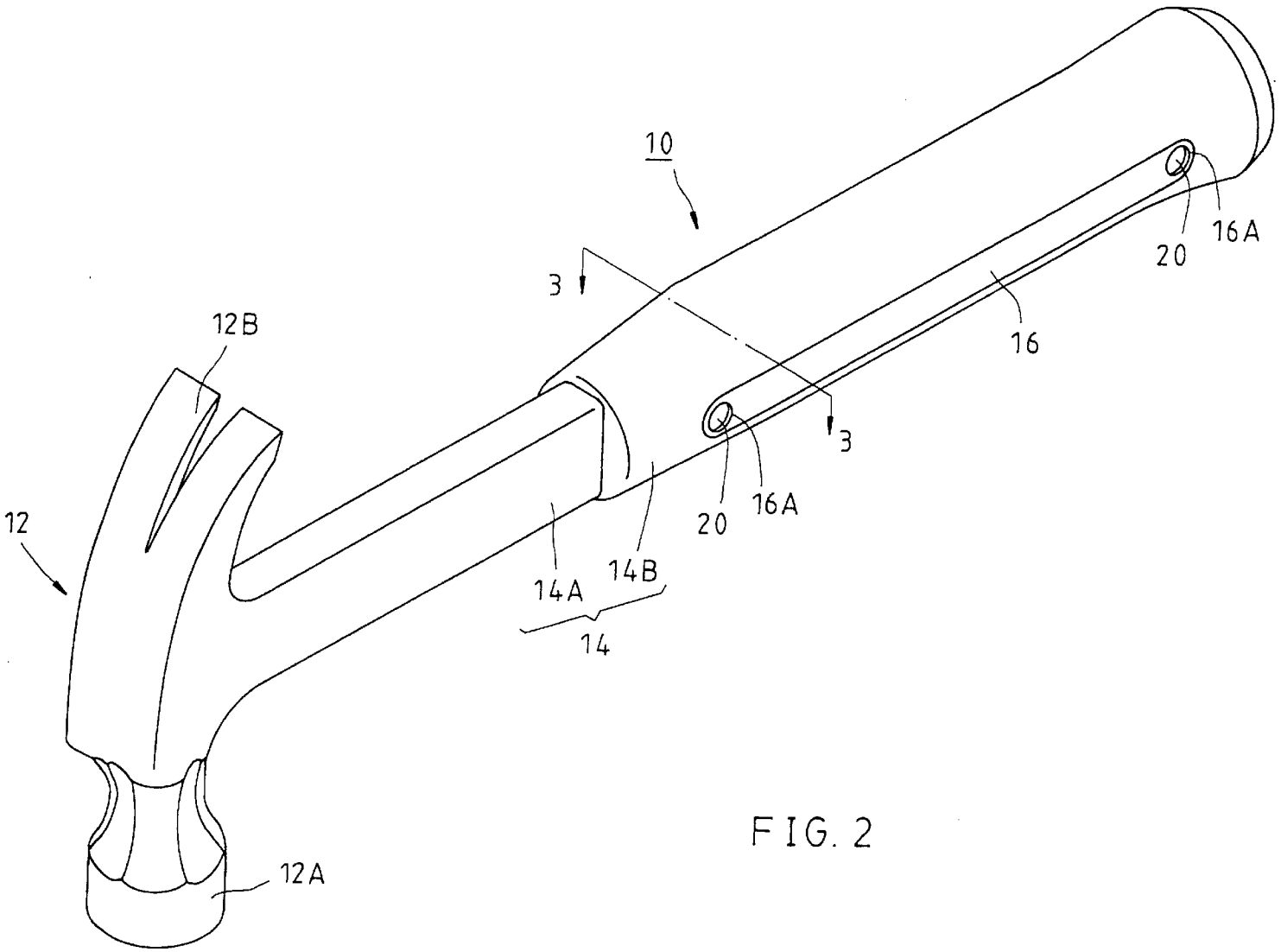
FIG. 2 shows a perspective view of the first preferred embodiment of the present invention in combination.
Figure 3:
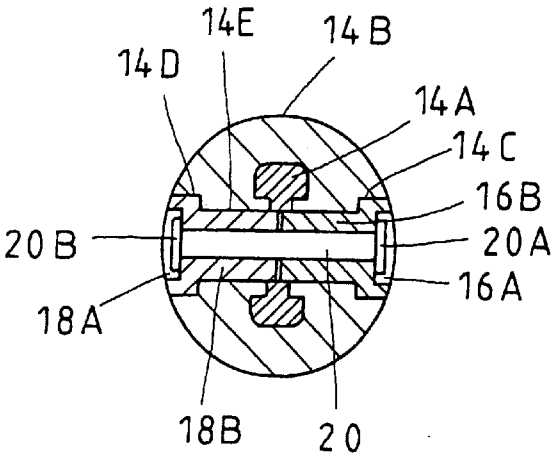
FIG. 3 shows a sectional view taken along the direction indicated by a line 3—3 as shown in FIG. 2.

As shown in FIGS. 1–3, a hand tool 10 of the first preferred embodiment of the present invention comprises a head 12, a handle 14, a first fastening member 16, a second fastening member 18, and two connection members 20.

The head 12 is made of a metal material and provided with a pounding end 12A and a nail removing end 12B.

The handle 14 has a body 14A and a protective sleeve 14B. The body 14A is fastened at one end thereof with the head 12. The protective sleeve 14B is made of an elastic plastic or rubber material and is fitted over the body 14A. The protective sleeve 14B is provided with a first groove 14C and a second groove 14D, which are opposite in location to each other and are extended along the direction of the longitudinal axis of the protective sleeve 14B. The protective sleeve 14B is further provided with a first through hole 14E and a second through hole 14F, which are respectively located at two longitudinal ends of the first groove 14C and the second groove 14D. These through holes penetrate through the protective sleeve 14B and the body 14A.

The first fastening member 16 is made of an aluminum plate and provided respectively at both ends thereof with a first sunk-head through hole 16A and a first tubular column 16B in communication with the first sunk-head through hole 16A. The second fastening member 18 is similar in construction to the first fastening member 16 and is respectively provided at both ends thereof with a second sunk-head through hole 18A and a second tubular column 18B in communication with the second sunk-head through hole 18A. In combination, the first fastening member 16 and the second fastening member 18 are respectively lodged in the first groove 14C and the second groove 14D such that the first tubular column 16B and the second tubular column 18B are respectively received in the first through hole 14E and the second through hole 14F, and that the first sunk-head through hole 16A and the second sunk-head through hole 18A are respectively in alignment and communication with the first through hole 14E and the second through hole 14F, as shown in FIG. 3.

The two connection members 20 are rivets, which are disposed in the sunk-head through holes 16A and 18A such that the rivets 20 penetrate the protective sleeve 14B and the body 14A, and that the heads 20A and 20B of these two rivets 20 press against the edges of the sunkhead through holes 16A and 18A. As a result, the first fastening member 16 and the second fastening member 18 are fastened securely together.

The protective sleeve 14B is thus secured in place by the first fastening member 16 and the second fastening member 18 such that the protective sleeve 14B and the body 14A are intimately held together. In the event that the protective sleeve 14B and the body 14A become separated after the prolonged use of the hand tool 10, the protective sleeve 14B is still held securely by the first fastening member 16 and the second fastening member 18, whose tubular columns 16B and 18B are securely anchored in the body 14A.

Figure 4:
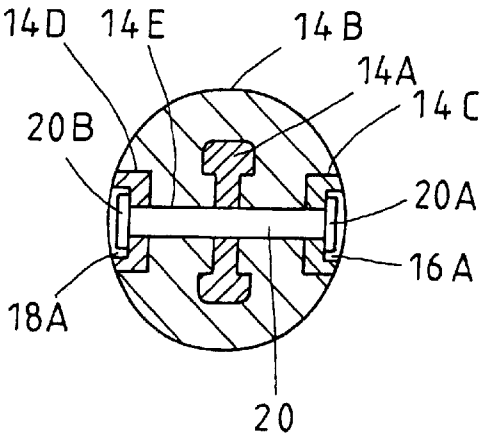
FIG. 4 shows a partial sectional view of a second preferred embodiment of the present invention.

As shown in FIG. 4, the second preferred embodiment of the present invention is basically similar in construction to the first preferred embodiment of the present invention, with the exception being that the first fastening member 16 and the second fastening member 18 of the former are devoid of the tubular columns 16B and 18B. In other words, the protective sleeve 14B of the second preferred embodiment is held securely to the body 14A by the first fastening member 16 and the second fastening member 18 in conjunction with the rivets 20 which are used to hold the first fastening member 16 and the second fastening member 18 together. The rivets 20 may be replaced by other types of the connection member, such as screws, fastening pins, tenon and mortise, etc.

Figure 6:
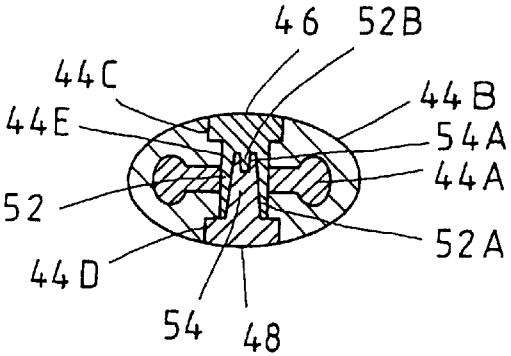
FIG. 6 shows a partial sectional view of the third preferred embodiment of the present invention.
Figure 5:
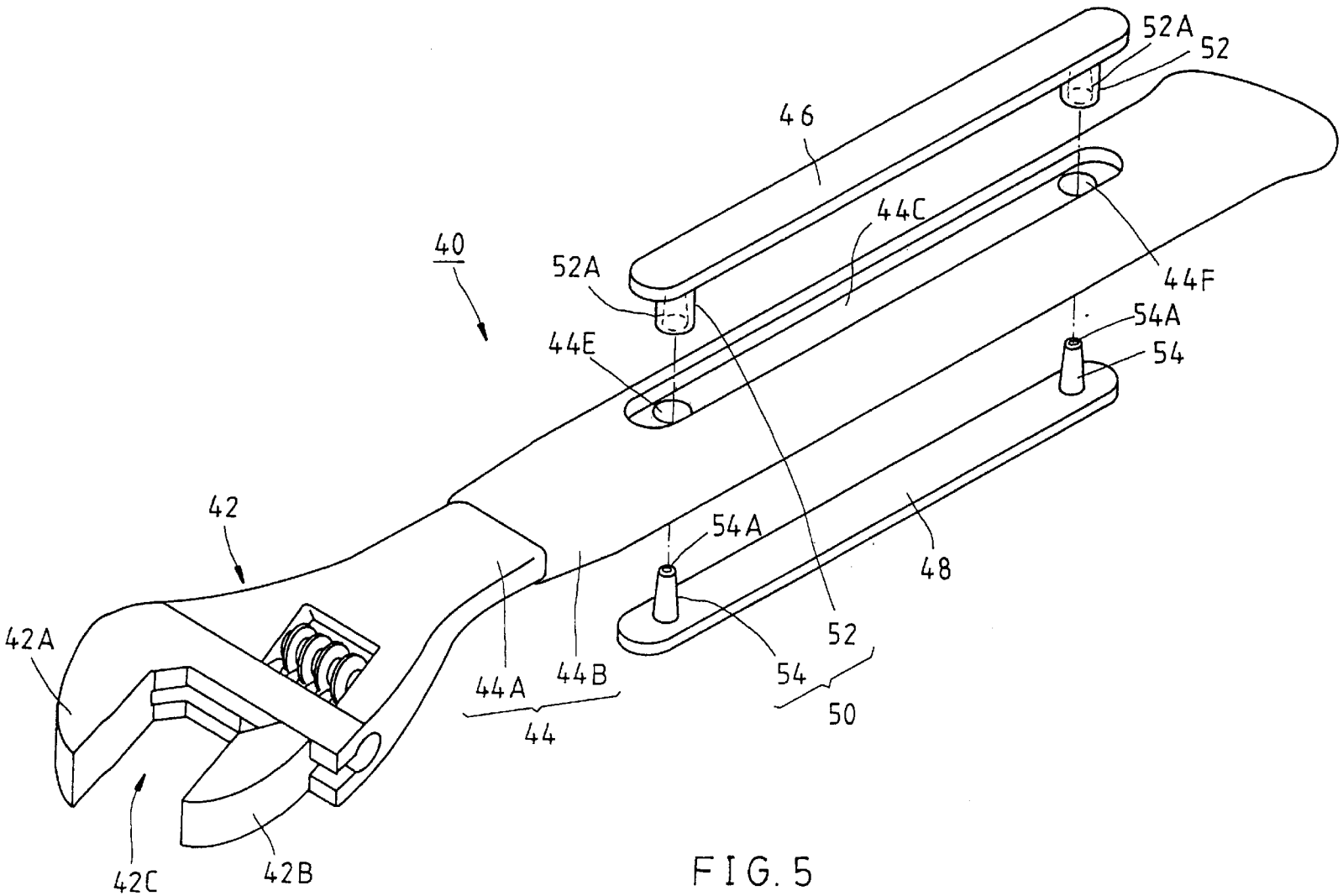
FIG. 5 shows an exploded view of a third preferred embodiment of the present invention.

Now referring to FIGS. 5 and 6, a hand tool 40 of the third preferred embodiment of the present invention is shown to comprise a head 42, a handle 44, a first fastening member 46, a second fastening member 48, and two connection members 50.

The head 42 is made of a metal material and is formed of a fixed jaw 42A, a movable jaw 42B, and a mouth 42C located between the fixed jaw 42A and the movable jaw 42B.

The handle 44 has a body 44A and a protective sleeve 44B. The body 44A is fastened at one end thereof with the head 42. The protective sleeve 44B is made of an elastic plastic or rubber material and is fitted over the body 44A. The protective sleeve 44B is provided with a first groove 44C and a second groove 44D, which are opposite in location to each other and are extended along the direction of the longitudinal axis of the protective sleeve 44B. The protective sleeve 44B is further provided with a first through hole 44E and a second through hole 44F, which are respectively located at two longitudinal ends of each of the two grooves 44C and 44D. The through holes 44E and 44F penetrate through the protective sleeve 44B and the body 44A.

The first fastening member 46 and the second fastening member 48 are made of an aluminum plate. The connection member 50 comprises a first columnar body 52, and a second columnar body 54, with the first columnar body 52 being integrally connected at one end thereof with the first fastening member 46, and with the first columnar body 52 being provided at other end thereof with a first tapered hole 52A which is provided in the underside thereof with a tapered pillar 52B. The second columnar body 54 is integrally connected at one end thereof with the second fastening member 48. The second columnar body 54 has a tapered profile and is provided at other end thereof with a second tapered hole 54A. In combination, the first and the second fastening members 46 and 48 are respectively lodged in the first and the second grooves 44C and 44D. The two connection members 50 are received respectively in the first and the second through holes 44E and 44F of the handle 44. The second columnar body 54 is fitted securely into the first tapered hole 52A of the first columnar body 52, whereas the tapered pillar 52B of the first columnar body 52 is securely fitted into the second tapered hole 54A of the second columnar body 54. The first and the second fastening members 56 and 58 can be thus connected quickly.

What is claimed is:

1. A hand tool having an improved handle and comprising:

a head; and a handle fastened at one end thereof with said head;

wherein said handle comprises;

a body fastened at one end thereof with said head;

a protective sleeve fitted over said body;

a first fastening member fastened to one longitudinal side of said protective sleeve for fastening said protective sleeve with said body;

a second fastening member fastened to other longitudinal side of said protective sleeve in such a manner that said second fastening member is opposite in location to said first fastening member whereby said second fastening member is used to fasten said protective sleeve with said body in conjunction with said first fastening member;

a first connection member penetrating said protective sleeve and said body to connect said first fastening member with said second fastening member;

wherein said one longitudinal side of said protective sleeve is provided with a first groove for locating said first fastening member; and wherein said other longitudinal side of said protective sleeve is provided with a second groove for locating said second fastening member.

2. The hand tool as defined in claim 1, wherein said handle is provided with a first through hole penetrating said body and said protective sleeve; and wherein said first fastening member and said second fastening member are each provided with a through hole corresponding in location to said first through hole of said handle whereby said through holes are intended to receive said connection member.

3. The hand tool as defined in claim 2, wherein said first fastening member and said second fastening member are provided with a first tubular column in communication with said through holes of said first fastening member and said second fastening member whereby said tubular column is lodged in said first through hole of said handle.

4. The hand tool as defined in claim 2, wherein said connection members is a rivet.

5. The hand tool as defined in claim 2, wherein said through holes of said first fastening member and said second fastening member are sunk-head through holes.

6. A hand tool having an improved handle and comprising:

a head; and a handle fastened at one end thereof with said head;

wherein said handle comprises;

a body fastened at one end thereof with said head;

a protective sleeve fitted over said body;

a first fastening member fastened to one longitudinal side of said protective sleeve for fastening said protective sleeve with said body;

a second fastening member fastened to other longitudinal side of said protective sleeve in such a manner that said second fastening member is opposite in location to said first fastening member whereby said second fastening member is used to fasten said protective sleeve with said body in conjunction with said first fastening member;

a first connection member penetrating said protective sleeve and said body to connect said first fastening member with said second fastening member;

wherein said handle is provided with a first through hole penetrating two opposite side walls of said protective sleeve whereby said two opposite side walls are provided respectively with a first groove and a second groove;

wherein said first fastening member is disposed in said first groove, with said second fastening member being disposed in said second groove whereby said first fastening member and said second fastening member are provided with a sunk-head through hole and a tubular column in communication with said sunk-head through hole, with said tubular column being lodged in said first through hole of said handle; and wherein said connection member is a rivet which is received in said first through hole of said handle and said sunk-head through holes of said first fastening member and said second fastening member, such that a head of said rivet is retained by an edge of said sunk-head through holes of said first fastening member and said second fastening member.

7. A hand tool having an improved handle and comprising:

a head; and a handle fastened at one end thereof with said head;

wherein said handle comprises;

a body fastened at one end thereof with said head;

a protective sleeve fitted over said body;

a first fastening member fastened to one longitudinal side of said protective sleeve for fastening said protective sleeve with said body;

a second fastening member fastened to other longitudinal side of said protective sleeve in such a manner that said second fastening member is opposite in location to said first fastening member whereby said second fastening member is used to fasten said protective sleeve with said body in conjunction with said first fastening member;

a first connection member penetrating said protective sleeve and said body to connect said first fastening member with said second fastening member;

wherein said handle is provided with a first through hole penetrating two opposite side walls of said protective sleeve; and wherein said connection member comprises a first columnar body and a second columnar body, with said first columnar body being connected at one end thereof with said first fastening member and provided at an opposite end thereof with a first tapered hole extending along a longitudinal direction of said first columnar body, said first tapered hole being provided in an underside thereof with a tapered pillar, and with said second columnar body being connected at one end thereof with said second fastening member and provided said opposite end thereof with a second tapered hole extending along a longitudinal direction of said second columnar body whereby said first columnar body and said second columnar body are received in said first through hole of said handle such that said second columnar body is received in said first tapered hole of said first columnar body, and that said first columnar body is received in said second tapered hole of said second columnar body.

8. The hand tool as defined in claim 7, wherein said two opposite side walls of said protective sleeve are provided respectively with a first groove for locating said first fastening member, and a second groove for locating said second fastening member.

9. The hand tool as defined in claim 7, wherein said one end of said first columnar body is integrally connected with said first fastening member; and wherein said one end of said second columnar body is integrally connected with said second fastening member.

* * * * *